US010897976B2

(12) United States Patent
Kang

(10) Patent No.: US 10,897,976 B2
(45) Date of Patent: Jan. 26, 2021

(54) FOUNDATION CONTAINER COMPRISING PUMP HAVING CONVENIENT PRESSURIZATION

(71) Applicant: Sungil Kang, Seongnam-si (KR)

(72) Inventor: Sungil Kang, Seongnam-si (KR)

( * ) Notice: Subject to any disclaimer, the term of this patent is extended or adjusted under 35 U.S.C. 154(b) by 670 days.

(21) Appl. No.: 15/507,604

(22) PCT Filed: Sep. 7, 2015

(86) PCT No.: PCT/KR2015/009434
§ 371 (c)(1),
(2) Date: Feb. 28, 2017

(87) PCT Pub. No.: WO2016/036228
PCT Pub. Date: Mar. 10, 2016

(65) Prior Publication Data

US 2017/0280852 A1 Oct. 5, 2017

(30) Foreign Application Priority Data

Sep. 5, 2014 (KR) ..... 20-2014-0006586 U

(51) Int. Cl.
*A45D 40/00* (2006.01)
*A45D 33/02* (2006.01)
(Continued)

(52) U.S. Cl.
CPC ..... *A45D 40/0075* (2013.01); *A45D 33/02* (2013.01); *A45D 33/025* (2013.01);
(Continued)

(58) Field of Classification Search
CPC .. A45D 2200/056; A45D 29/12; A45D 33/02; A45D 33/025; A45D 34/00;
(Continued)

(56) References Cited

U.S. PATENT DOCUMENTS 4,678,105 A * 7/1987 Heck ..... A47K 11/10 222/153.13
4,795,063 A * 1/1989 Sekiguchi ..... F04B 23/023 222/105
(Continued)

FOREIGN PATENT DOCUMENTS

KR 10-2010-0128968 A 12/2010
KR 10-2012-0138690 A 12/2012
(Continued)

*Primary Examiner* — Yogesh P Patel
*Assistant Examiner* — Jennifer Gill
(74) *Attorney, Agent, or Firm* — Heedong Chae; Lucem, PC

(57) ABSTRACT

The present invention relates to a foundation container comprising a pump having convenient pressurization and, more specifically, to a foundation container comprising a pump having convenient pressurization, wherein the outer wall of a pump main body is formed in the shape of an inwardly concave janggu (a Korean traditional hourglass drum), thereby not delimiting a pumping method to vertically pressurizing the center of a pump upper body, but facilitating the discharge of the contents even though any region of the pump upper body is pressurized. In addition, the present invention relates to a foundation container comprising a pump having convenient pressurization, wherein productivity is improved due to easy mass production by integrating a pump upper body and a pump main body in one body and forming a discharge valve and a suction valve in the same shape so as to simplify the structure of a pump.

8 Claims, 10 Drawing Sheets

(51) Int. Cl.

| | |
|---|---|
| ***B05B 11/00*** | (2006.01) |
| ***B05B 1/14*** | (2006.01) |
| ***A45D 34/00*** | (2006.01) |
| ***A45D 40/22*** | (2006.01) |
| ***B65D 43/16*** | (2006.01) |

(52) U.S. Cl.
CPC ..... *A45D 34/00* (2013.01); *A45D 40/222* (2013.01); *B05B 1/14* (2013.01); *B05B 11/007* (2013.01); *B05B 11/0072* (2013.01); *B05B 11/00412* (2018.08); *B05B 11/3002* (2013.01); *B05B 11/3033* (2013.01); *B05B 11/3069* (2013.01); *B65D 43/163* (2013.01); *A45D 2040/223* (2013.01); *A45D 2200/056* (2013.01); *B05B 11/00416* (2018.08); *B05B 11/3074* (2013.01)

(58) Field of Classification Search
CPC .. A45D 40/00; A45D 40/0075; A45D 33/008; A45D 33/06; A45D 40/22; A45D 2040/223; B05B 1/14; B05B 11/00412; B05B 11/0072; B05B 11/0075; B05B 11/3002; B05B 11/3028; B05B 11/3033; B05B 11/3069; B05B 11/3074; B65D 47/20; B65D 83/0005; B65D 83/06; B65D 83/0038; B65D 83/0022; B65D 43/164; B65D 43/163
USPC ..... 132/216, 309
See application file for complete search history.

(56) References Cited

U.S. PATENT DOCUMENTS 4,844,299 A * 7/1989 Sekiguchi ..... B05B 11/00412 222/94
6,021,924 A * 2/2000 Suck ..... B05B 11/3023 222/105
9,555,951 B2 * 1/2017 Kang ..... B29C 51/162
9,718,073 B2 * 8/2017 Kang ..... A45D 34/00
9,937,510 B2 * 4/2018 Kang ..... B05B 11/3028
10,285,486 B2 * 5/2019 Kang ..... A45D 34/00
10,328,451 B2 * 6/2019 Kang ..... B65D 77/04
10,399,763 B2 * 9/2019 Kang ..... B05B 11/3028
2006/0147351 A1 * 7/2006 Falb ..... B01L 3/0203 422/400
2009/0120963 A1 * 5/2009 Bae ..... B05B 11/0032 222/153.13
2011/0220682 A1 * 9/2011 Lim ..... B05B 11/3023 222/183
2012/0305606 A1 * 12/2012 Lee ..... A45D 33/02 222/256
2014/0291351 A1 * 10/2014 Kang ..... B29C 51/162 222/105
2015/0108171 A1 * 4/2015 Kim ..... B05B 11/3001 222/321.3
2016/0136666 A1 * 5/2016 Kang ..... B05B 11/3028 222/182
2016/0227903 A1 * 8/2016 Kang ..... A45D 34/00
2016/0303602 A1 * 10/2016 Kang ..... B05B 11/3025
2016/0339465 A1 * 11/2016 Lefevre ..... B05B 11/3047
2017/0049213 A1 * 2/2017 Kang ..... A45D 34/00
2017/0280850 A1 * 10/2017 Lee ..... A45D 33/003
2017/0326578 A1 * 11/2017 Kang ..... B65D 77/04
2018/0318863 A1 * 11/2018 Presche ..... B05B 11/3028
2019/0255547 A1 * 8/2019 Goettke ..... B05B 11/00416

FOREIGN PATENT DOCUMENTS

KR 10-2013-0013135 A 2/2013
KR 10-1280934 * 5/2013
KR 20-0470757 * 1/2014
KR 10-1390993 B1 5/2014
KR 10-1429089 B1 8/2014
WO WO 2014171732 * 4/2014

* cited by examiner

-- PRIOR ART --

-- PRIOR ART --

FOUNDATION CONTAINER COMPRISING PUMP HAVING CONVENIENT PRESSURIZATION

CROSS-REFERENCE TO RELATED APPLICATION

This application claims the benefit of Korean application No. 20-2014-0006586, filed on Sep. 5, 2014 with the Korean Intellectual Property Office, the disclosure of which is incorporated herein by reference.

TECHNICAL FIELD

The present invention relates to a foundation container including a pump having convenient pressurization and, more specifically, to a foundation container including a pump having convenient pressurization, wherein an outer wall of a pump main body is formed in the shape of an inwardly concave janggu (a Korean traditional hourglass drum), thereby not delimiting a pumping method to vertically pressurizing the center of a pump upper body, but facilitating the discharge of the contents even though any region of the pump upper body is pressurized.

In addition, the present invention relates to a foundation container including a pump having convenient pressurization, wherein productivity is improved due to easy mass production by integrating the pump upper body and the pump main body in one body and forming a discharge valve and a suction valve in the same shape so as to simplify the structure of the pump.

BACKGROUND ART

A foundation is used to give a toning effect to the skin and to cover a defect on the skin.

The foundation is classified into a solid foundation, a liquid foundation and a gel foundation according to a type of cosmetic contents. Although the solid foundation produces an effect of excellently covering the skin, the solid foundation may be conglomerated when correcting the makeup, and although the liquid foundation gives a good close contact feel, the persistency of the liquid foundation is weak. Thus, in recent years, a number of customers favoring the gel foundation having a considerable persistency and giving the good close contact feel when applied to the skin have been increased.

Accordingly, it has been necessary to develop a container for the gel foundation. In general, the gel foundation is filled in a glass container or a tube container, and is used such that when using the gel foundation, a user takes out or squeezes the gel foundation on a hand of the user, and applies the gel foundation to the skin by using a puff or the hand.

However, according to the related art, the cosmetic contents are put on the hand whenever the user uses the gel foundation, so that it may be inconvenient for use.

In order to solve the problem as described above, as shown in FIGS. 1A-B, the inventor filed Korean Utility Model Application No. 20-2013-0007876 disclosing a foundation container having a pump with a short stroke distance and a content diffusion member, in which a suction valve plate 110, a discharge valve 120, and an elastic member 130 are provided to simplify the structure of the pump, the volume of a content temporary storage 160 is changed to perform pumping by moving a pump upper body 140 equipped with the discharge valve 120 upwards and downwards inside a pump main body 150 so that the stroke distance of the pump can be shortened, and a content diffusion member 170 is provided on an upper end of the pump upper body 140 to uniformly diffuse the cosmetic contents to an impregnation member 180 so that the cosmetic contents impregnated into the impregnation member 180 can be applied to the skin by the user using the puff. Accordingly, when the gel foundation is filled in the container for use, the cosmetic contents are not put on the hand during the makeup, and are convenient to carry.

However, according to the related art, since the pump main body 150 to which the pump upper body 140 and a pump lower body 190 are coupled is not movable, a pressurizing position is delimited. Thus, in order to perform the pumping, the user needs to vertically pressurize a center portion of the impregnation member 180 by using the puff, so that it may be inconvenient for use.

In addition, the pump used in the related art includes the suction valve plate 110, the discharge valve 120, and the elastic member 130 to simplify the structure of the pump. However, in order to assemble the pump, there are provided a coupling assistance member 121 for allowing the discharge valve 120 to be assembled onto the pump upper body 140, and a plurality of coupling annular protrusions and coupling grooves including a coupling annular protrusion 122, a valve annular protrusion 123, a sealing annular protrusion 124, an extension annular protrusion 124 and the like, so that the structure is not effectively simplified, and thus the number of assembling steps is increased, lowering the productivity.

In addition, the impregnation member 180 impregnated with the cosmetic contents is exposed when the cosmetics are used, so that the cosmetic contents may be contaminated and dried, and thus functions of the cosmetic contents may not be exerted.

DISCLOSURE

Technical Problem

The present invention is made to solve the above problems, and an object of the present invention is to provide a foundation container including a pump having convenient pressurization, wherein an outer wall of a pump main body is formed in the shape of an inwardly concave janggu (a Korean traditional hourglass drum), thereby not delimiting a pumping method to vertically pressurizing the center of a pump upper body, but facilitating the discharge of the contents even though any region of the pump upper body is pressurized.

In addition, an object of the present invention is to provide a foundation container including a pump having convenient pressurization, wherein the pump main body is folded when assembling the pump upper body and a pump lower body, and the pump main body is formed at an outer wall thereof with an annular groove so as to be easily folded during pumping.

In addition, an object of the present invention is to provide a foundation container including a pump having convenient pressurization, wherein productivity is improved due to easy mass production by integrating the pump upper body and the pump main body in one body and forming a discharge valve and a suction valve in the same shape so as to simplify the structure of the pump.

In addition, an object of the present invention is to provide a foundation container including a pump having convenient pressurization, wherein the pump is provided to prevent contents stored inside the foundation container from making contact with air, so that the contents are prevented from being contaminated so as to be used for a long period of time in a clean and sanitary state.

Technical Solution

The present invention provides a foundation container including an outer container body 10 and an outer container lid 20 hinged to the outer container body 10 so as to be opened and closed, the foundation container including:

an inner container body 30 coupled inside the outer container body 10;

a pump lower plate 40 coupled to an upper portion of the inner container body 30 to seal the inner container body 30, formed at an upper portion thereof with a suction hole 45, and having a suction valve 44 for selectively opening and closing the suction hole 45;

a pump main body 50 coupled to the upper portion of the pump lower plate 40, and having a cylindrical outer wall;

a pump upper body 60 provided at an upper portion of the pump main body 50, formed at an upper portion thereof with a discharge hole 65, and having a discharge valve 63 for selectively opening and closing the discharge hole 65; and an elastic member 70 provided between the pump main body 50 and the pump upper body 60 to elastically support the pump upper body 60.

In addition, the inner container body 30 may have an open top, may be formed at a bottom thereof with an air flow hole 33, and may be provided around a side surface thereof with the inner container body inner wall 31 and the inner container body outer wall 32.

In addition, the inner container body 30 may further include an auxiliary container 34 or a push plate formed inside the inner container body 30.

In addition, there may be further provided an impregnation member 80 provided inside the inner container body 30 or the auxiliary container 34 and formed of porous urethane foam.

In addition, the pump lower plate 40 may have a pump lower plate inner wall 41 and a pump lower plate outer wall 42 extending downwards, may be formed on an upper inner side surface thereof with a latching sill 46 fitted with the pump main body 50, and may have a seating annular groove 47 between the latching sill 46 and the suction hole 45.

In addition, the pump lower plate inner wall 41 may make close contact with an inner side of the inner container body inner wall 31 to enhance sealing capability, and the pump lower plate outer wall 42 may be coupled between the inner container body inner wall 31 and the inner container body outer wall 32.

In addition, an inner circumferential surface of the pump lower plate outer wall 42 and an outer circumferential surface of the inner container body inner wall 31 may be formed thereon with an undercut or a screw thread so that the pump lower plate outer wall 42 and the inner container body inner wall 31 can be undercut-coupled or screw-coupled with each other.

In addition, an upper extension piece 43 may be formed upwards from an outer circumferential surface of the pump lower plate 40, and a first latching protrusion 431 may be formed on an outer side surface of the upper extension piece 43.

In addition, the first latching protrusion 431 may be formed on the outer side surface of the upper extension piece 43 of the pump lower plate 40, and a second latching protrusion 611 may be formed at an inner side of a side wall 61 of the pump upper body 60, such that the first latching protrusion 431 is coupled with the second latching protrusion 611.

In addition, the pump main body 50 may have a seating annular protrusion 51 extending downwards so as to be fitted into a seating annular groove 47 of the pump lower plate 40, and a side surface seating portion 52 may extend outwards from the seating annular protrusion 51.

In addition, the outer wall of the pump main body 50 may be formed at an outer circumferential surface thereof with an annular groove 53 so as to allow the pump main body 50 to be folded.

In addition, the outer wall of the pump main body 50 may be inwardly recessed in a shape of "> <".

In addition, the pump main body 50 may be formed of at least one of general rubber, elastomer, silicone rubber, NBR rubber, and a synthetic resin material having excellent elasticity such as polyethylene (PE) and polypropylene (PP).

In addition, the pump upper body 60 may be formed integrally with or separately from the upper portion of the pump main body 50.

In addition, the pump upper body 60 may be formed at a lower surface thereof with an elastic member fixing annular protrusion 62 spaced apart from the outer wall of the pump main body 50 by a predetermined distance.

In addition, the pump lower plate 40 and the pump upper body 60 may be formed of at least one of elastic synthetic resin materials such as polyethylene (PE) or polypropylene (PP).

In addition, the elastic member 70 may be provided between the lower surface of the pump upper body 60 and a side surface seating portion 52 of the pump main body 50, and fixed by the elastic member fixing annular protrusion 62 of the pump upper body 60.

In addition, the suction valve 44 and the discharge valve 63 are preferably formed in the same shape.

In addition, the suction valve 44 and the discharge valve 63 may have a suction valve blade 441 and a discharge valve blade 631 for selectively opening and closing the suction hole 45 and the discharge hole 65, respectively.

In addition, the suction valve 44 and the discharge valve 63 may be formed of at least one of the general rubber, the elastomer, the silicone rubber, the NBR rubber, and the synthetic resin material having excellent elasticity such as polyethylene (PE) and polypropylene (PP).

Advantageous Effects

According to the present invention, there is provided a foundation container including a pump having convenient pressurization, wherein an outer wall of a pump main body is formed in the shape of an inwardly concave janggu (a Korean traditional hourglass drum), thereby not delimiting a pumping method to vertically pressurizing the center of a pump upper body, but facilitating the discharge of the contents even though any region of the pump upper body is pressurized.

In addition, there is provided a foundation container including a pump having convenient pressurization, wherein the pump main body is folded when assembling the pump upper body and a pump lower body, and the pump main body is formed at an outer wall thereof with an annular groove so as to be easily folded during pumping.

In addition, there is provided a foundation container including a pump having convenient pressurization, wherein productivity is improved due to easy mass production by integrating the pump upper body and the pump main body in one body and forming a discharge valve and a suction valve in the same shape so as to simplify the structure of the pump.

In addition, there is provided a foundation container including a pump having convenient pressurization, wherein the pump is provided to prevent contents stored inside the foundation container from making contact with air, so that cosmetic contents are prevented from being contaminated so as to be used for a long period of time in a clean and sanitary state.

BEST MODE

Mode for Invention

A foundation container including a pump having convenient pressurization according to a first embodiment of the present invention will be described with reference to accompanying drawings.

Figure 1A:
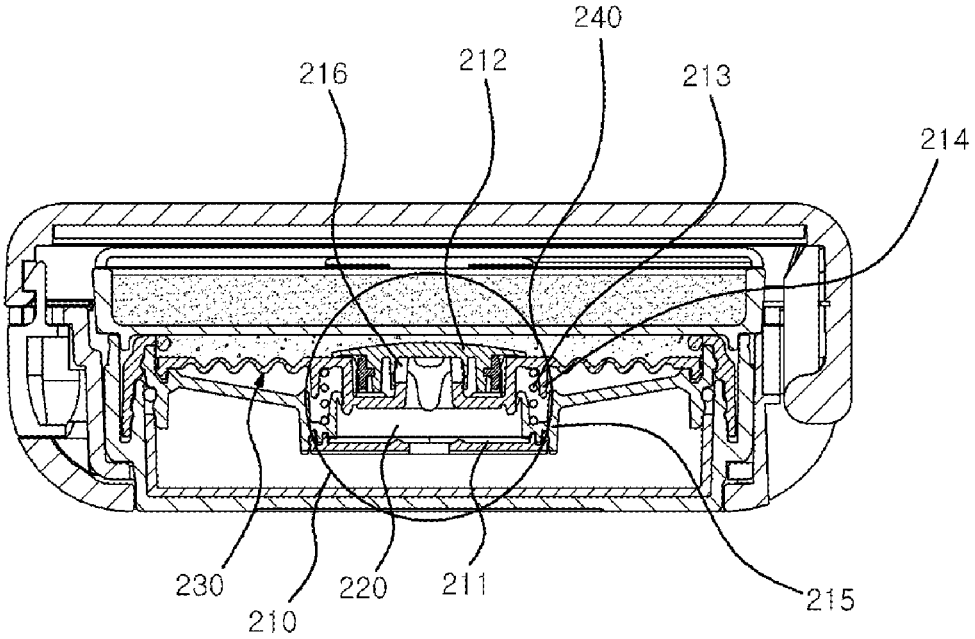
FIGS. 1A-B show, respectively, a sectional view and a partially enlarged view of a foundation container according to the related art.
Figure 1B:
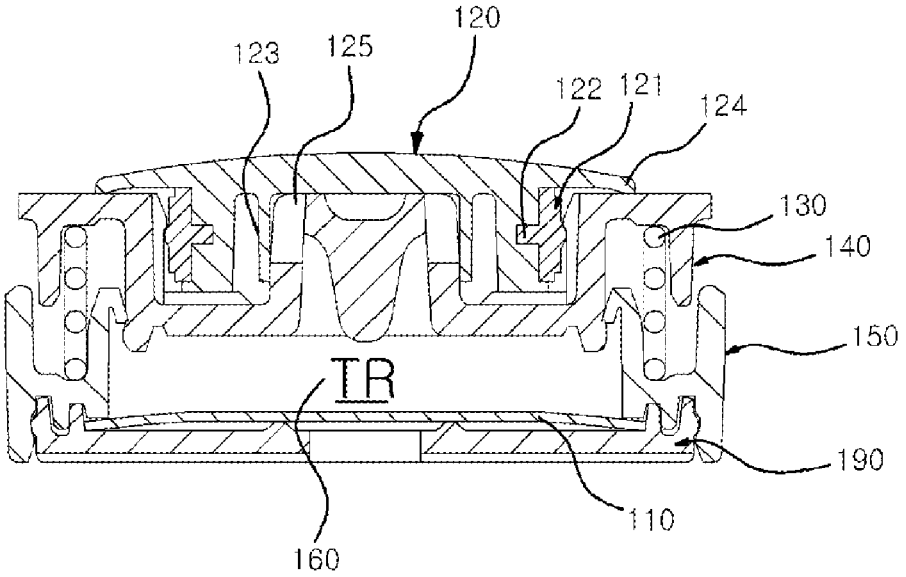
Figure 2:
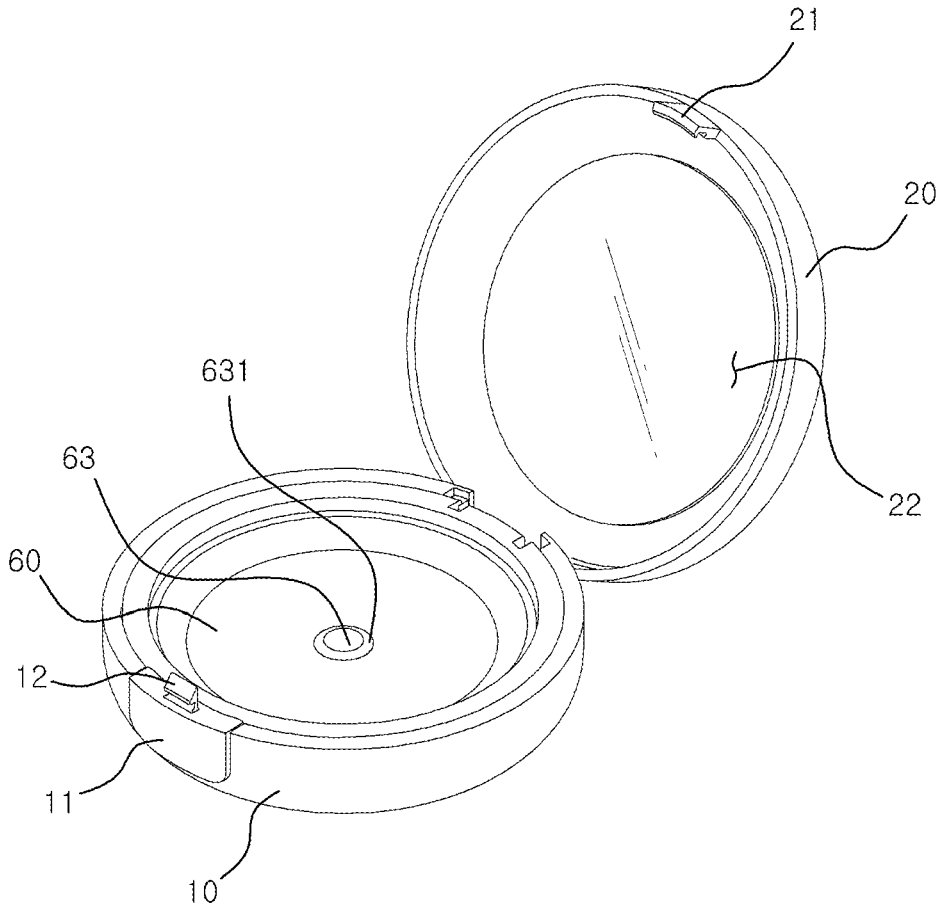
FIG. 2 is a perspective view showing a foundation container including a pump having convenient pressurization according to a first embodiment of the present invention.
Figure 3:
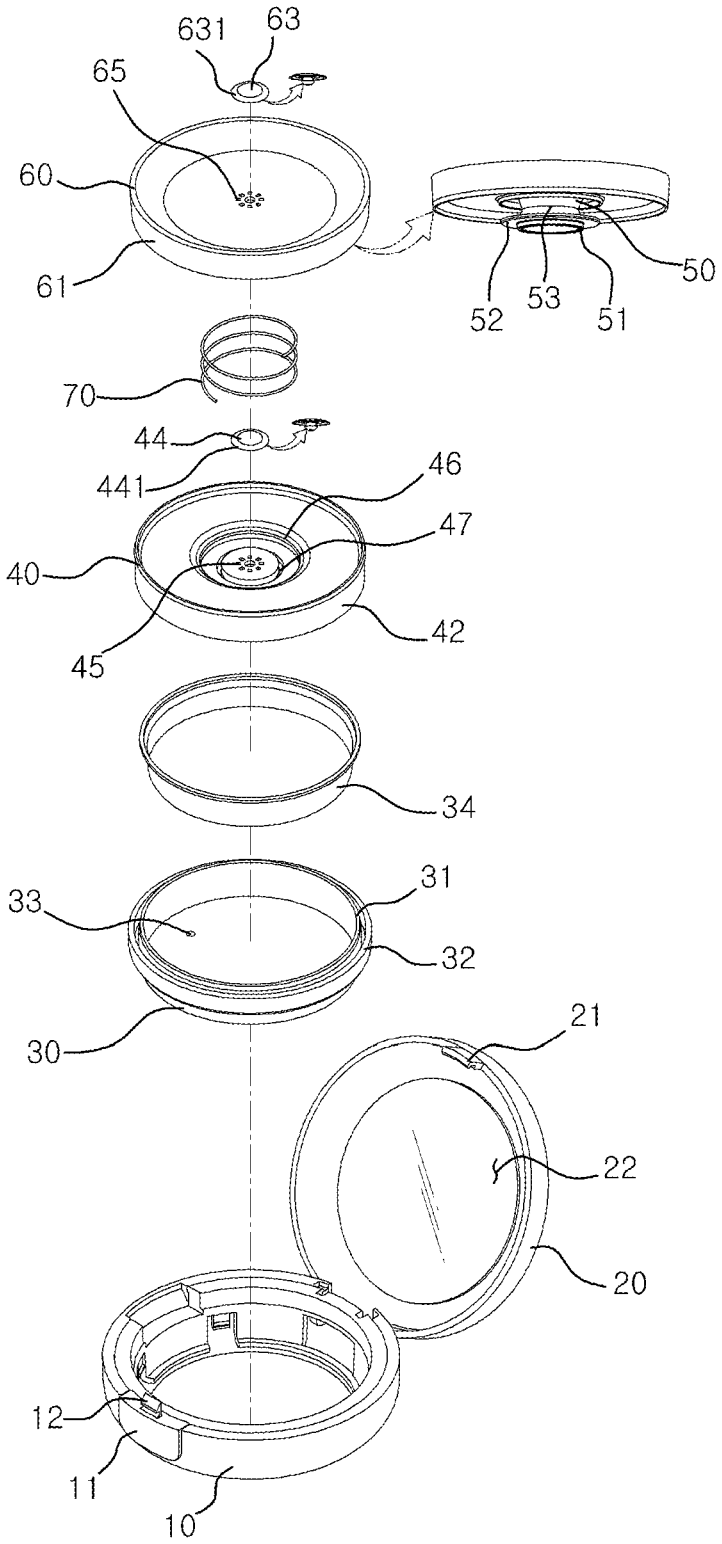
FIG. 3 is an exploded perspective view showing the foundation container including the pump having convenient pressurization according to the first embodiment of the present invention.
Figure 4:
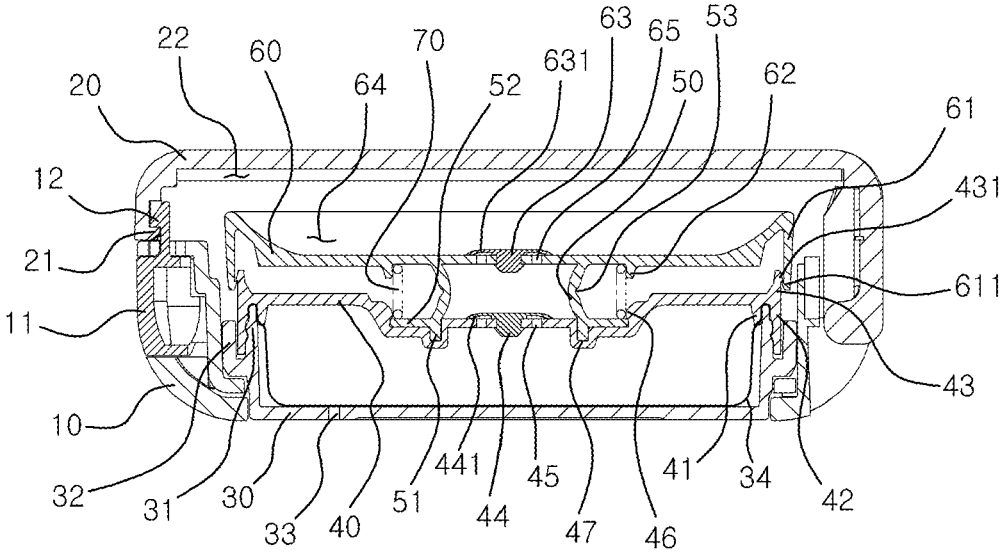
FIG. 4 is a sectional view showing the foundation container including the pump having convenient pressurization according to the first embodiment of the present invention.
Figure 5:
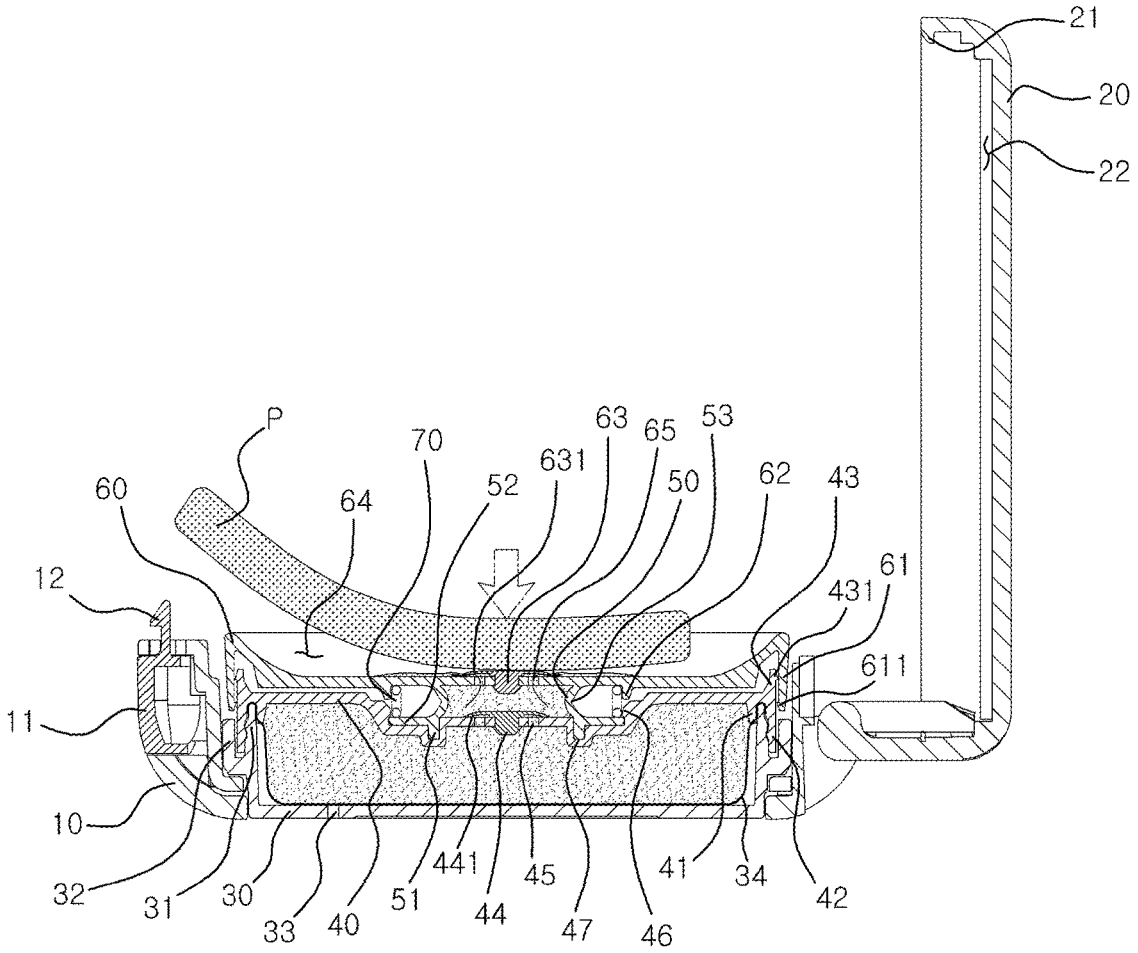
FIG. 5 is a sectional view showing the foundation container including the pump having convenient pressurization in a state that a pump upper body of the foundation container is pressurized according to the first embodiment of the present invention.
Figure 6:
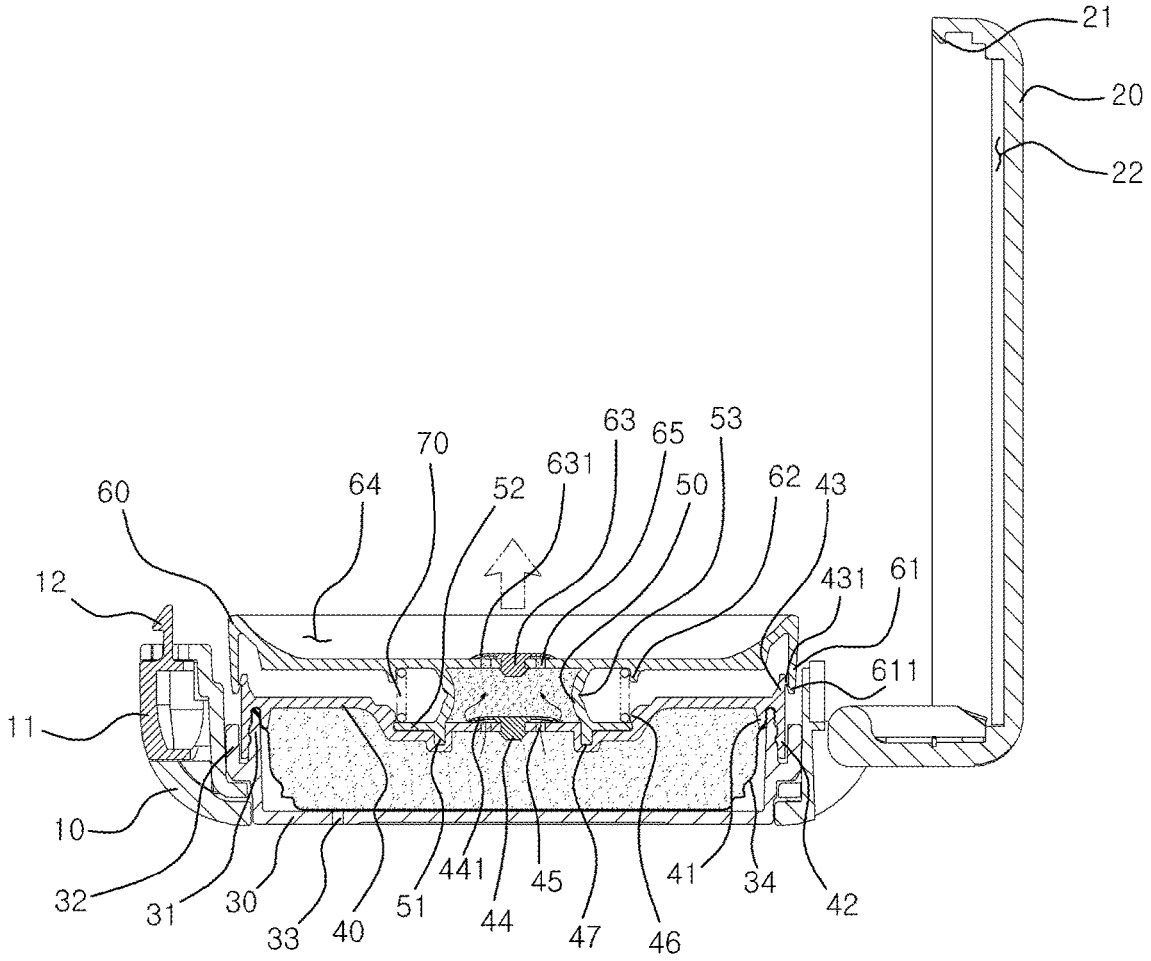
FIG. 6 is a sectional view showing the foundation container including the pump having convenient pressurization in a state that the pressurization on the pump upper body is released according to the first embodiment of the present invention.

FIG. 2 is a perspective view showing a foundation container including a pump having convenient pressurization according to a first embodiment of the present invention, and FIG. 3 is an exploded perspective view showing the foundation container including the pump having convenient pressurization according to the first embodiment of the present invention. FIG. 4 is a sectional view showing the foundation container including the pump having convenient pressurization according to the first embodiment of the present invention, and FIG. 5 is a sectional view showing the foundation container including the pump having convenient pressurization in a state that a pump upper body of the foundation container is pressurized according to the first embodiment of the present invention. FIG. 6 is a sectional view showing the foundation container including the pump having convenient pressurization in a state that the pressurization on the pump upper body is released according to the first embodiment of the present invention.

The present invention provides a foundation container including an outer container body 10 and an outer container lid 20 hinged to the outer container body 10 so as to be opened and closed, the foundation container including: an inner container body 30 coupled inside the outer container body 10, a pump lower plate 40 coupled to an upper portion of the inner container body 30 to seal the inner container body 30, formed at an upper portion thereof with a suction hole 45, and having a suction valve 44 for selectively opening and closing the suction hole 45, a pump main body 50 coupled to the upper portion of the pump lower plate 40, and having a cylindrical outer wall, a pump upper body 60 provided at an upper portion of the pump main body 50, formed at an upper portion thereof with a discharge hole 65, and having a discharge valve 63 for selectively opening and closing the discharge hole 65, and an elastic member 70 provided between the pump main body 50 and the pump upper body 60 to elastically support the pump upper body 60.

The outer container body 10 has a button 11 provided at one side surface thereof with a latching protrusion 12. In addition, the outer container body 10 has a hinge located in opposition to the button 11, so that the outer container body 10 can be hinged to the outer container lid 20. The inner container body 30 is accommodated in the outer container body 10.

As the user presses the button 11, the latching protrusion 12 extending from an upper portion of the button 11 is smoothly moved back so that the latching protrusion 12 may be separated from a hook 21 of the outer container lid 20.

The outer container lid 20 covers an upper portion of the outer container 10, is hingedly connected to the outer container 10, and serves to open or close the outer container 10.

The hook 21 is provided at one side of the outer container lid 20 and formed in a protrusion shape corresponding to the latching protrusion 12 of the outer container 10.

In addition, a mirror 22 is provided at an inner side of the outer container lid 20 to allow a user to easily perform the makeup.

The inner container body 30 has an open top, is provided around a side surface thereof with the inner container body inner wall 31 and the inner container body outer wall 32, and is formed at a bottom thereof with an air flow hole 33.

A pump lower plate outer wall 42 extending downwards from the pump lower plate 40 is fitted between the inner container body inner wall 31 and the inner container body outer wall 32.

The air is introduced into the air flow hole 33 so that the contents stored in the inner container body 30 can be smoothly discharged.

In addition, the inner container body 30 may further include an auxiliary container 34 or a push plate formed inside the inner container body 30.

The auxiliary container 34 stores the contents and is formed of a thin and easily deformable material. Particularly, the auxiliary container 34 may be formed of at least one of a vinyl material, a synthetic resin material, general rubber, elastomer, silicone rubber, and NBR rubber.

The auxiliary container 34 may be formed with the inner container body 30 by double injection, or may be formed separately from and assembled with the inner container body 30.

The present invention will be described based on a separately formed structure.

Figure 10:
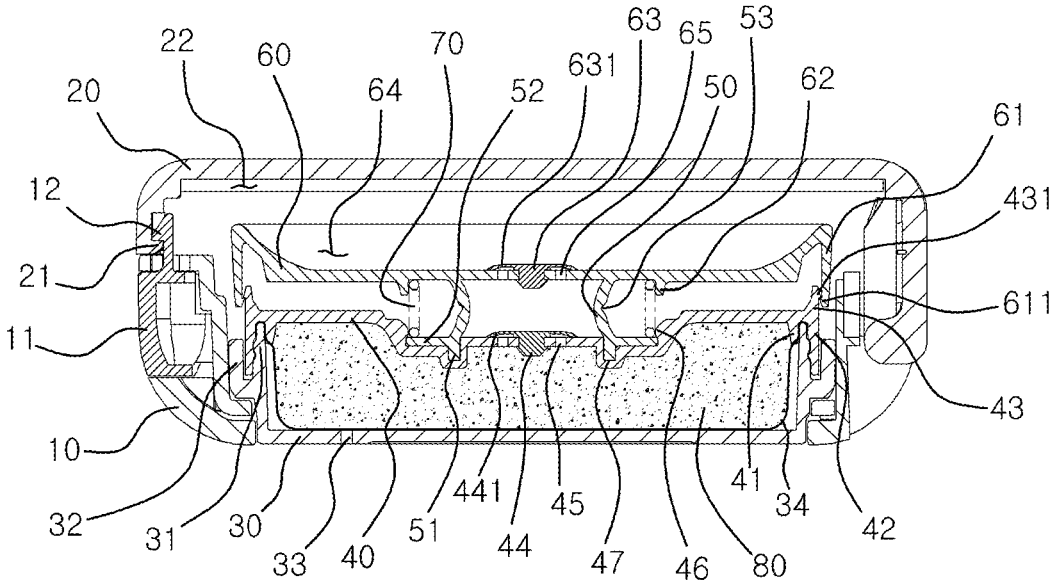
FIG. 10 is a sectional view showing a foundation container including a pump having convenient pressurization according to a fourth embodiment of the present invention.

When storing the contents in the auxiliary container 34, as shown in FIG. 10, there may be further provided an impregnation member 80 provided inside the auxiliary container 34 and formed of porous urethane foam according to the fourth embodiment of the present invention.

The auxiliary container 34 is latched to the inner container body inner wall 31 of the inner container body 30.

The pump lower plate 40 is coupled to the upper portion of the inner container body 30 to seal the inner container body 30.

The pump lower plate 40 is preferably formed of at least one of elastic synthetic resin materials such as polyethylene (PE) or polypropylene (PP).

The pump lower plate 40 laterally extends to cover upper portions of the inner container body 30 and the auxiliary container 34, has a pump lower plate inner wall 41 and a pump lower plate outer wall 42 extending downwards, and is formed at the center thereof with the suction hole 45.

The pump lower plate inner wall 41 is fitted inside the inner container body inner wall 31 of the inner container body 30 to enhance sealing capability, and the pump lower plate outer wall 42 is fitted between the inner container body inner wall 31 and the inner container body outer wall 32 formed in the inner container body 30, such that the auxiliary container 34 latched to the inner container body inner wall 31 of the inner container body 30 is prevented from being pressurized by the inner container body inner wall 31 and the inner container body outer wall 32 so as to be separated from the inner container body inner wall 31 of the inner container body 30.

In addition, an inner circumferential surface of the pump lower plate outer wall 42 and an outer circumferential surface of the inner container body inner wall 31 may be formed thereon with an undercut or a screw thread so that the pump lower plate outer wall 42 and the inner container body inner wall 31 can be undercut-coupled or screw-coupled with each other.

The suction hole 45 serves as a passage through which the contents stored in the auxiliary container 34 are transferred to the pump main body 50.

The suction hole 45 is selectively opened and closed by the suction valve 44.

The suction valve 44 is preferably formed of at least one of general rubber, elastomer, silicone rubber, NBR rubber, and a synthetic resin material having excellent elasticity such as polyethylene (PE) and polypropylene (PP).

The suction valve 44 is coupled to the center of the suction hole 45, and has a suction valve blade 441 extending laterally.

The suction valve blade 441 selectively opens and closes the suction hole 45 as shown in FIGS. 5 and 6.

An upper extension piece 43 extends upwards from the pump lower plate outer wall 42, and a first latching protrusion 431 is formed on an outer side surface of the upper extension piece 43.

The first latching protrusion 431 is coupled with a second latching protrusion 611 formed on a side wall 61 of the pump upper body 60 so as to prevent the pump upper body 60 from being separated from the pump lower plate 40.

The pump lower plate 40 is formed on an upper inner side surface thereof with a latching sill 46 fitted with the pump main body 50, and has a seating annular groove 47 between the latching sill 46 and the suction hole 45.

The latching sill 46 is latched to a side surface seating portion 52 formed in the pump main body 50 so as to serve to fix the pump main body 50 to the pump lower plate 40.

The pump main body 50 is seated onto the seating annular groove 47 so as to be prevented from being separated.

The pump main body 50 is coupled to the upper portion of the pump lower plate 40, has a cylindrical outer wall, and formed in a shape of a janggu (a Korean traditional hourglass drum).

As shown in FIG. 4, the outer wall of the pump main body 50 is formed in a shape of an inwardly concave janggu (a Korean traditional hourglass drum), thereby facilitating the discharge of the contents even though any region of the pump upper body 60 is pressurized in a pumping method.

The pump main body 50 is preferably formed of at least one of the general rubber, the elastomer, the silicone rubber, the NBR rubber, and the synthetic resin material having excellent elasticity such as polyethylene (PE) and polypropylene (PP).

The pump main body 50 has a seating annular protrusion 51 extending downwards, the side surface seating portion 52 extends outwards from the seating annular protrusion 51, and the outer wall of the pump main body 50 is formed at an outer circumferential surface thereof with an annular groove 53.

The seating annular protrusion 51 is fitted into the seating annular groove 47 of the pump lower plate 40 so as to prevent the pump main body 50 from being separated from the pump lower plate 40.

The side surface seating portion 52 is latched to the latching sill 46 of the pump lower plate 40 to fix the pump main body 50 to the pump lower plate 40.

The annular groove 53 is formed at the outer circumferential surface of the outer wall of the pump main body 50, so that when the pump main body 50 is pressurized as shown in FIG. 5, the outer wall is easily folded inwards.

Figure 7:
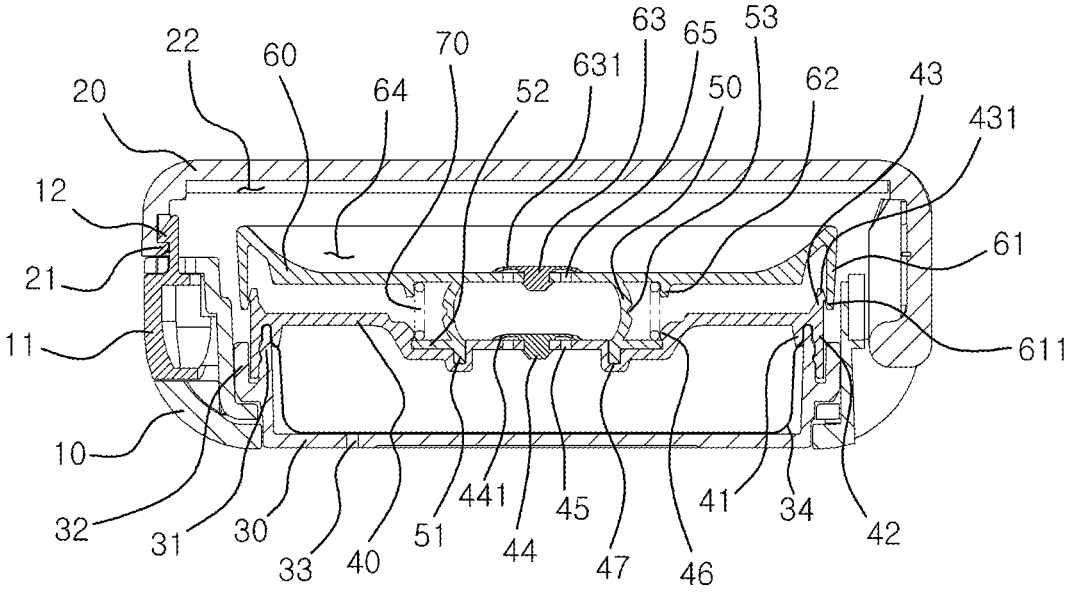
FIG. 7 is a sectional view showing a foundation container including a pump having convenient pressurization according to a second embodiment of the present invention.

In addition, according to the second embodiment of the present invention as shown in FIG. 7, a center portion of the outer wall of the pump main body 50 outwardly protrudes in a shape of "< >".

The pump upper body 60 is formed integrally with the upper portion of the pump main body 50, extends laterally, has the side wall 61 formed downwards from the pump upper body 60, and has the second latching protrusion 611 formed at an inner side of the side wall 61.

The pump upper body 60 is preferably formed of at least one of the elastic synthetic resin materials such as polyethylene (PE) or polypropylene (PP).

In addition, the pump upper body 60 may be formed separately from and coupled to the upper portion of the pump main body 50 to achieve a sealed state.

The present invention will be described based on a structure in which the pump upper body 60 is formed integrally with the pump main body 50.

The pump upper body 60 is formed integrally with the pump main body 50, so that the structure of the pump is simplified, thereby improving productivity due to easy mass production.

The second latching protrusion 611 is coupled with the first latching protrusion 431 formed on the upper extension piece 43 of the pump lower plate 40 so as to prevent the pump upper body 60 from being separated from the pump lower plate 40.

The pump upper body 60 is formed at a lower surface thereof with an elastic member fixing annular protrusion 62 spaced apart from the outer wall of the pump main body 50 by a predetermined distance.

The elastic member 70 is provided between the lower surface of the pump upper body 60 and the side surface seating portion 52 of the pump main body 50 so as to elastically support the pump upper body 60, and fixed by the elastic member fixing annular protrusion 62.

In addition, the pump upper body 60 is provided at the upper portion thereof with a puff storage space 64 for storing a puff therein.

The pump upper body 60 is formed at the center thereof with the discharge hole 65, and the discharge hole 65 is selectively opened and closed by the discharge valve 63.

The discharge valve 63 has a discharge valve blade 631 for selectively opening and closing the discharge hole 65.

The discharge valve 63 is preferably formed of at least one of the general rubber, the elastomer, the silicone rubber, the NBR rubber, and the synthetic resin material having excellent elasticity such as polyethylene (PE) and polypropylene (PP).

In addition, the discharge valve 63 and the suction valve 44 may be formed in the same shape, thereby improving productivity.

Figure 8:
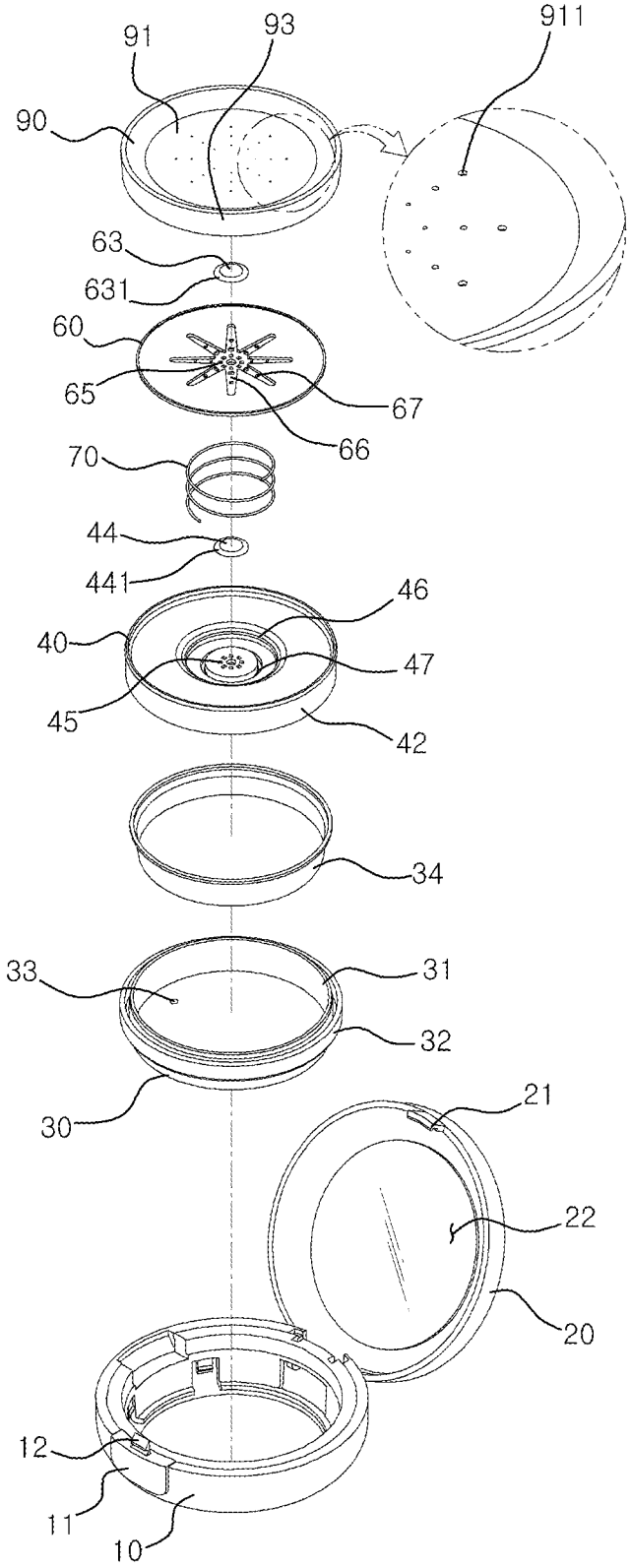
FIG. 8 is an exploded perspective view showing a foundation container including a pump having convenient pressurization according to a third embodiment of the present invention.
Figure 9:
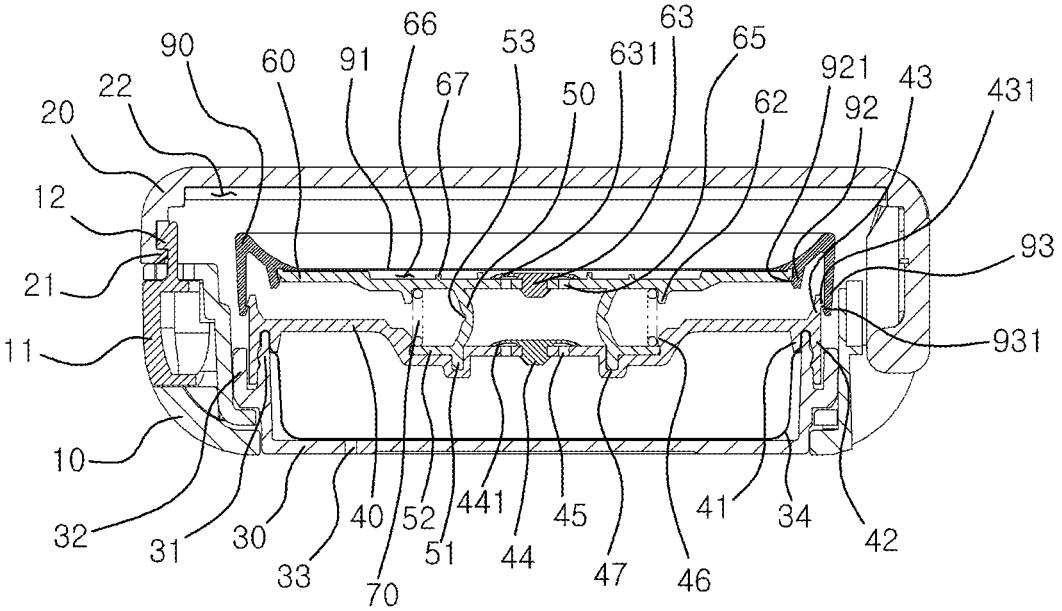
FIG. 9 is a sectional view showing the foundation container including the pump having convenient pressurization according to the third embodiment of the present invention.

In addition, as shown in FIGS. 8 and 9, the pump upper body 60 is formed in a horizontal circular plate shape, and there is further provided a discharge member 90 fixedly coupled to an upper end of the pump upper body 60.

A content outflow groove 66 is formed radially around the discharge valve 63 at the center of the pump upper body 60, and a control protrusion 67 is formed in the content outflow groove 66.

The control protrusion 67 controls a flow rate of the contents so that the contents are uniformly discharged to the discharge member 90.

The discharge member 90 is formed with a discharge plate 91 having a plurality of discharge ports 911, and has a first lower extension piece 92 formed downwards and a second lower extension piece 93 spaced apart from the first lower extension piece 92 by a predetermined distance.

The discharge ports 911 are radially formed corresponding to the content outflow groove 66, such that sizes of the discharge ports 911 are gradually increased outwards from a center portion of the discharge plate.

When the contents are discharged through the discharge ports 911, the amount of the contents flowing through the content outflow groove 66 is gradually reduced in the outward direction, so that the sizes of the discharge ports 911 is increased to uniformly discharge the contents through the discharge ports 911.

The first lower extension piece 92 is formed at an inner side thereof with a pump upper body coupling protrusion 921 fixedly coupled to an edge of the pump upper body 60.

The second lower extension piece 93 is formed at an inner side thereof with a pump lower plate coupling protrusion 931 coupled with the first latching protrusion 431 of the pump lower plate 40.

A method of assembling and using the foundation container including the pump having convenient pressurization according to the embodiments of the present invention will be described in detail as follows.

In order to assemble the foundation container including the pump having convenient pressurization according to the present invention, there are provided an outer container body 10 and an outer container lid 20 hinged to the outer container body 10, in which an inner container body 30 is coupled inside the outer container body 10, and an auxiliary container 34 is mounted in the inner container body 30.

The auxiliary container 34 may be provided therein with contents, or may be mounted therein with an impregnation member 80 formed of porous urethane foam.

Thereafter, a pump lower plate 40 is coupled to upper portions of the inner container body 30 and the auxiliary container 34, and a suction valve 44 is coupled to the center of the pump lower plate 40.

In addition, a pump main body 50 is coupled to an upper portion of the pump lower plate 40.

The suction valve 44 is formed in the pump lower plate 40 so as to serve to selectively open and close a suction hole 45.

An outer wall of the pump main body 50 may be formed in a shape of an inwardly concave janggu (a Korean traditional hourglass drum) as shown in FIG. 4, and a center portion of the outer wall of the pump main body 50 may outwardly protrude in a shape of "< >" as shown in FIG. 7.

A pump upper body 60 may be formed integrally with an upper portion of the pump main body 50, or the pump upper body 60 formed separately from the upper portion of the pump main body 50 may be coupled to the upper portion of the pump main body 50.

In addition, an elastic member 70 is provided between a lower surface of the pump upper body 60 and a side surface seating portion 52 of the pump main body 50 to elastically support the pump upper body 60.

When the pump upper body 60 is formed integrally with the 20 pump main body 50, the structure of the pump is simplified, thereby improving productivity due to easy mass production.

The pump upper body 60 may be formed separately from and coupled to the upper portion of the pump main body 50 to achieve a sealed state.

The pump upper body 60 has a second latching protrusion 611 coupled with a first latching protrusion 431 of the pump lower plate 40, so that the pump upper body 60 is prevented from being separated.

In addition, as shown in FIGS. 8 and 9, the pump upper body 60 is formed in a horizontal circular plate shape, and there is further provided a discharge member 90 fixedly coupled to an upper end of the pump upper body 60.

In order to use the foundation container including the pump having convenient pressurization, which is assembled through the method as described above, the outer container lid 20 is opened and the pump upper body 60 is pressurized using a puff P as shown in FIG. 5.

When the pump upper body 60 is pressurized, the pump main body 50 is folded at an annular groove 53 formed on the pump main body 50 as the pump main body 50 is pressurized. Accordingly, the volume inside the pump main body 50 is reduced, so that a discharge pressure is generated inside the pump main body 50. Therefore, the contents mounted inside the pump main body 50 are extruded while pushing a discharge valve blade 631 of a discharge valve 63 formed in the pump upper body 60, and discharged through a discharge hole 65 of the pump upper body 60.

In addition, the suction valve 44 formed in the pump lower plate 40 is pushed by the discharge pressure inside the pump main body 50, thereby pressing and closing the suction hole 45 of the pump lower plate 40.

The outer wall of the pump main body 50 is formed in the shape of the inwardly concave janggu (the Korean traditional hourglass drum), thereby facilitating the discharge of the contents even though any region of the pump upper body 60 is pressurized in the pumping method, and when the pump main body 50 is pressurized by the annular groove 53 formed on the pump main body 50 as shown in FIG. 5, the outer wall is easily folded inwards.

When the force applied to an upper surface of the pump upper body 60 is removed, as shown in FIG. 6, the outer wall of the pump main body 50 moves upwards as the pump main body 50 moves upwards due to an elastic force of the elastic member 70, so that the folded outer wall becomes unfolded.

Accordingly, the volume inside the pump main body 50 is increased, so that a vacuum pressure is generated inside the pump main body 50. Therefore, the discharge hole 65 is closed by the discharge valve blade 631 of the discharge valve 63 formed in the pump upper body 60, and a suction valve blade 441 of the suction valve 44 formed in the pump lower plate 40 is lifted upwards due to the vacuum pressure inside the pump main body 50 so as to open the suction hole 45, so that the contents mounted inside the inner container body 30 are transferred inside the pump main body 50.

As a result, the auxiliary container 34 in the inner container body 30 is dented corresponding to the discharged contents. Alternatively, if a push plate is mounted instead of the auxiliary container 34, the push plate is raised corresponding to the discharged contents.

As described above, although the foundation container including the pump having convenient pressurization according to one embodiment of the present invention has been described for illustrative purposes, the present invention is not limited thereto. It is understood that various changes and modifications can be made by those skilled in the art without departing from the scope and spirit of the invention as disclosed in the accompanying claims.

DESCRIPTION OF REFERENCE NUMERALS

| | |
|---|---|
| 10: Outer container body | 11: Button |
| 12: Latching protrusion | 20: Outer container lid |
| 21: Hook | 22: Mirror |
| 30: Inner container body | |
| 31: Inner container body inner wall | |
| 32: Inner container body outer wall | |
| 33: Air flow hole | 34: Auxiliary container |
| 40: Pump lower plate | 41: Inner wall |
| 42: Outer wall | 43: Upper extension piece |
| 431: First latching protrusion | 44: Suction valve |
| 441: Suction valve blade | 45: Suction hole |
| 46: Latching sill | 47: Seating annular groove |
| 50: Pump main body | 51: Seating annular protrusion |
| 52: Side surface seating portion | 53: Annular groove |
| 60: Pump upper body | 61: Side wall |
| 611: Second latching protrusion | 62: Elastic portion |
| 63: Discharge valve | 631: Discharge valve blade |
| 64: Puff storage space | 65: Discharge hole |
| 66: Outflow groove | 67: Control protrusion |
| 70: Elastic member | 80: Impregnation member |
| 90: Discharge member | 91: Discharge plate |
| 911: Discharge port | 92: First lower extension piece |
| 921: Pump upper body coupling protrusion | |
| 93: Second lower extension piece | |
| 931: Pump lower plate coupling protrusion | |

The invention claimed is:

1. A foundation container comprising: a pump having pressurization; an outer container body (10) and an outer container lid (20) hinged to the outer container body (10) so as to be opened and;

an inner container body (30) coupled inside the outer container body (10);

a pump lower plate (40) coupled to an upper portion of the inner container body (30) to seal the inner container body (30), formed at an upper portion of the pump lower plate (40) with a suction hole (45), and having a suction valve (44) for selectively opening and closing the suction hole (45);

a pump main body (50) coupled to the upper portion of the pump lower plate (40), and having a cylindrical outer wall;

a pump upper body (60) provided at an upper portion of the pump main body (50), formed at an upper portion thereof with a discharge hole (65), and having a discharge valve (63) for B selectively opening and closing the discharge hole (65);

an elastic member (70) provided between the pump main body (50) and the pump upper body (60) to elastically support the B pump upper body (60);

wherein the outer wall of the pump main body (50) is inwardly recessed such that opposing sides of the pump outer wall have a shape of a greater-than sign facing and aligned with a less-than sign; and wherein the outer wall of the pump main body (50) is formed at an outer circumferential surface thereof with an annular groove (53) forming a living hinge to allow dynamic folding of the pump main body (50) during pumping.

2. The foundation container of claim 1, further comprising an auxiliary container (34) formed inside the inner container body (30).

3. The foundation container of claim 2, further comprising an impregnation member (80) provided inside the inner container body (30) or the auxiliary container (34), and formed of porous urethane foam.

4. The foundation container of claim 1, wherein the pump lower plate (40) has a pump lower plate inner wall (41) and a pump lower plate outer wall (42) extending downwards, is formed on an upper inner side surface thereof with a latching sill (46) fitted with the pump main body (50), and has a seating annular groove (47) between the latching sill (46) and the suction hole (45).

5. The foundation container of claim 1, wherein the pump main body (50) has a seating annular protrusion (51) extending downwards so as to be fitted into a seating annular groove (47) of the pump lower plate (40), and a side surface seating portion (52) extends outwards from the seating annular protrusion (51).

6. The foundation container of claim 1, wherein the pump upper body (60) is formed integrally with or separately from the upper portion of the pump main body (50).

7. The foundation container of claim 1, wherein the suction valve (44) and the discharge valve (63) have a suction valve blade (441) and a discharge valve blade (631) for selectively, and elastically, opening and closing the suction hole (45) and the discharge hole (65), respectively.

8. The foundation container of claim 1, wherein the pump upper body (60) is formed in a horizontal circular plate shape, and the foundation container further comprises a discharge member (90) fixedly coupled to an upper end of the pump upper body (60).

* * * * *